US005791826A

United States Patent [19]

Moran

[11] Patent Number: 5,791,826

[45] Date of Patent: Aug. 11, 1998

[54] EMBANKMENT RETAINING WALL SYSTEM

[76] Inventor: Damian A. Moran, Site 10, Box 12, R.R. #1, DeWinton, Alberta, Canada, T0L 0X0

[21] Appl. No.: 718,236

[22] Filed: Sep. 20, 1996

[51] Int. Cl.[6] ..... E02D 5/00

[52] U.S. Cl. ..... 405/284; 52/604; 405/285

[58] Field of Search ..... 405/284–286; 52/604, 169.1, 169.3, 169.4; D24/126, 128, 133, 135

[56] References Cited

U.S. PATENT DOCUMENTS

| | | | |
|---|---|---|---|
| 4,050,254 | 9/1977 | Meheen et al. | 405/285 |
| 4,341,491 | 7/1982 | Neumann | 405/258 |
| 4,572,711 | 2/1986 | Benson et al. | 405/286 |
| 4,804,299 | 2/1989 | Forte et al. | 405/286 X |
| 4,914,887 | 4/1990 | Meheen | 405/284 |
| 5,154,032 | 10/1992 | Ritter | 405/284 X |
| 5,178,492 | 1/1993 | Meheen | 405/284 |

*Primary Examiner*—Tamara L. Graysay
*Assistant Examiner*—Tara L. Mayo
*Attorney, Agent, or Firm*—Thomas E. Malyszko

[57] ABSTRACT

In an assembly for constructing a multi-tiered retaining wall to support a backfilled embankment, at least one generally planar backfill retaining wall panel has opposed top and bottom edges, and opposed parallel side edges. Each wall panel spans between pairs of transversely spaced posts. Each post is in the form of a rigid elongate column having an upper end, a lower end and opposed side portions. An abutment forming a recessed area extends longitudinally along each side portion of the column for receiving the side edge of the wall panel. A pin element insertable into the column retains the wall panel in place between pairs of columns in the abutment prior to backfilling against a rear surface of the wall panel. A seat at the upper end of the column supports a wall panel of an adjacent higher tier. A saddle at the lower end of the column provides for free-standing support of the column on a wall panel on an adjacent lower tier prior to backfilling. A connector extends from the column for connection to a wire mesh for anchoring the column to the backfilled embankment. The column further provides a wall panel of an upper tier with a predetermined set-back into the embankment in relation to a wall panel in an adjacent lower tier.

40 Claims, 4 Drawing Sheets

EMBANKMENT RETAINING WALL SYSTEM

FIELD OF THE INVENTION

The present. invention relates to retaining wall systems, and in particular gabiontype retaining walls.

BACKGROUND OF THE INVENTION

Various methods of constructing retaining walls have been proposed for erecting and supporting embankments of earth, for example beside elevated highway overpasses and intersections. One such method, sometimes referred to as gabion-type embankments or construction, employs modular structural units of suitable gravel partly or fully enclosed in prefabricated wire meshes or the like, each of which may be integrally cast to a front segment or panel. These cells of gravel are arranged side-by-side in tiers one atop another as required. The wall's gravel mass functions to hold back the soil embankment, and the front panels form an outer shell of the wall. A disadvantage of such construction is that each successive tier must be individually leveled and aligned prior to installing the next tier. This is time consuming and inefficient, and hence costly. The individual cells are also difficult to handle because they are bulky and heavy, further hampering alignment and leveling procedures.

An improvement to such wall construction is disclosed in U.S. Pat. No. 4,914,887 to Meheen which employs pillar-like columns for engaging individual wall panels. Each column has a vertical key-slot for receiving an enlarged rib at the end of a wire mesh. The mesh retains the column to the embankment. These ribs also vertically interconnect the columns, and a system of pins interconnect the wall panels to form a wall. However, this arrangement suffers from several disadvantages which limit its applicability. First, there is no apparent way of inclining or setting-back the wall toward the embankment if required for structural integrity of the embankment or merely for aesthetic reasons. Second, a conventional mesh cannot be attached to the columns, only one specifically configured to engage the vertical key-slot. Third, there is no disclosed manner of staggering the columns laterally in the plane of the wall, rather the columns must be stacked one atop another. Hence, setting a column above a wall panel to construct a retaining wall does not appear possible in this system. Fourth, there is no means for positive column support of adjacent wall panels prior to backfilling, nor can the wall panels be supported atop the columns.

What is desired therefore is an embankment retaining wall system which combines the structural concepts of gabions with precast wall panel units in a manner designed for a singular, continuous and uniform method of construction, and which overcomes the limitations and disadvantages of these other prior art systems. Preferably the system should reduce or minimize the amount of leveling and alignment work necessary to construct the retaining wall. The system should also provide for a controlled and predetermined set-back of the retaining wall to avoid the time delays and possible errors of having to establish such set-backs manually in the field. Further, the posts or columns of the system should not be limited to vertical alignment with, and support on, other posts exclusively. Rather, the posts should be capable of support atop the wall panels of the system to provide a greater flexibility of arrangement and installation. The posts should also be capable of supporting themselves as well as adjacent wall panels in a free-standing manner prior to introducing a mesh or backfilling. Yet further, the posts of the system should be capable of simple on-site connection to a conventional gabion type mesh for ease of use and to further reduce manufacturing and installation costs.

SUMMARY OF THE INVENTION

In one aspect the present invention provides an assembly for constructing a multitiered retaining wall to support a backfilled embankment comprising:

- at least one generally planar backfill retaining wall panel having opposed top and bottom edges, and opposed parallel side edges;
- at least two transversely spaced posts wherein said wall panels span between pairs of said posts, each of said posts comprising:
  - a rigid elongate column having an upper end, a lower end and opposed side portions;
  - an abutment means extending longitudinally along each side portion for receiving said side edge of the wall panel;
  - means for retaining said wall panel in place between a pair of said posts in said abutment means prior to backfilling against a rear surface of said wall panel;
  - a seat means at said upper end of the column for supporting a wall panel on an adjacent higher tier;
  - a saddle means at said lower end of the column for free-standing support of said post on a wall panel on an adjacent lower tier prior to said backfilling; and
  - means extending from said post for connection to a mesh for anchoring said post to said backfilled embankment.

In another aspect the invention provides a post for use with at least one wall panel spanning between pairs of said posts for constructing a multi-tiered retaining wall to support a backfilled embankment, said wall panel having opposed top and bottom edges and opposed generally parallel side edges, said post comprising:

- a rigid elongate column having an upper end, a lower end and opposed side portions;
- an abutment means extending longitudinally along each side portion for receiving said side edge of the wall panel;
- means for retaining said wall panel in said abutment means prior to backfilling against a rear surface of said wall panel;
- a seat means at said upper end of the column for supporting a wall panel on an adjacent higher tier;
- a saddle means at said lower end of the column for free-standing support of said column and any wall panel retained in said column's abutment means on a wall panel on an adjacent lower tier prior to said backfilling; and
- means for connecting said column to a mesh for anchoring said column to said backfilled embankment.

DESCRIPTION OF THE DRAWINGS

Embodiments of the invention will now be described, by way of example only, with reference to the accompanying drawings, wherein.

DESCRIPTION OF PREFERRED EMBODIMENTS

Figure 1:
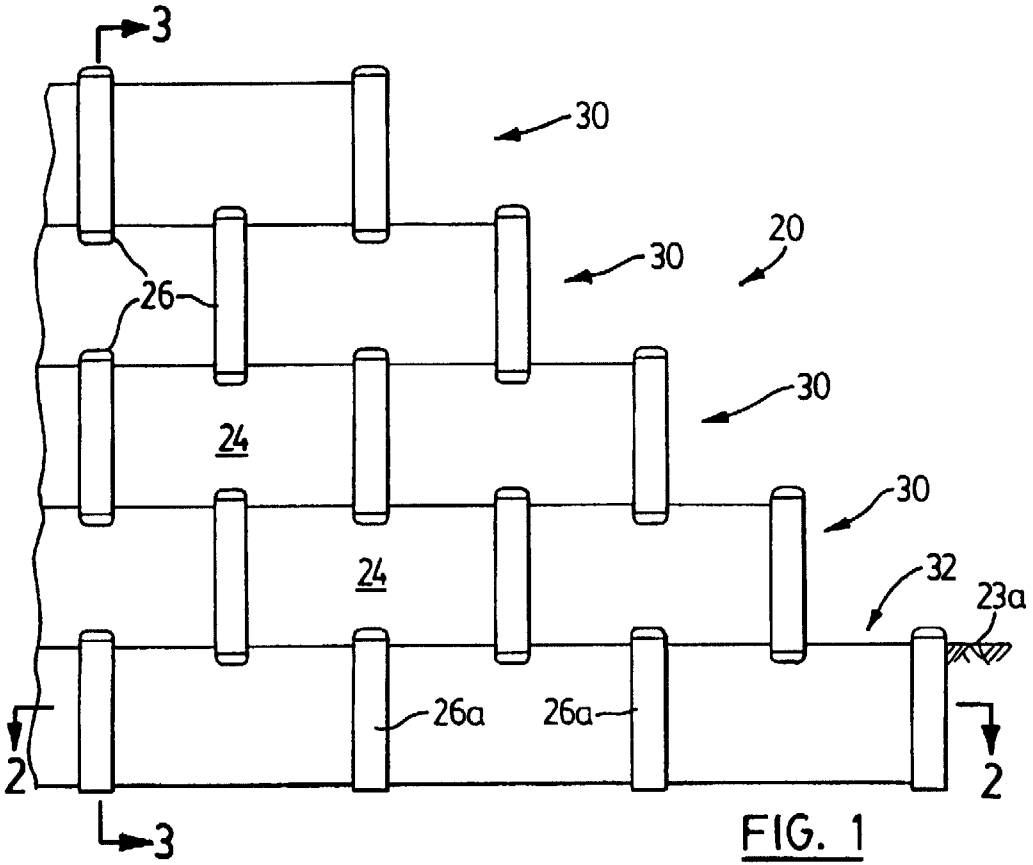
FIG. 1 is an elevated frontal view above and below grade of a multi-tierd retaining wall constructed according to a preferred embodiment of the present invention.
Figure 3:
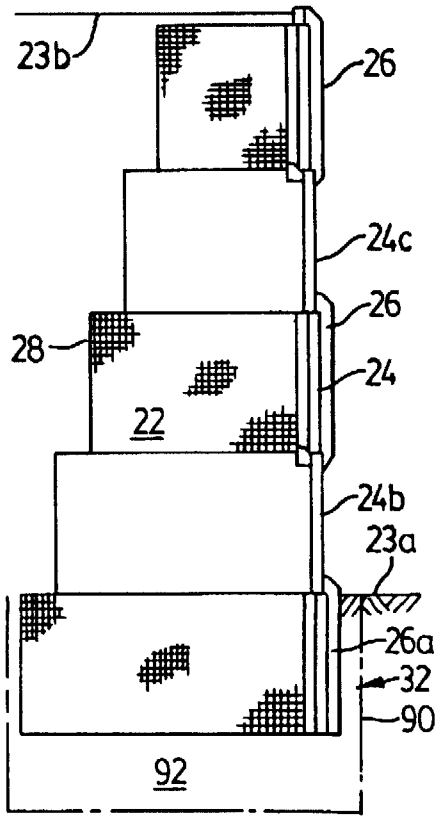
FIG. 3 is a cross-sectional side view taken on line 3—3 of FIG. 1.
Figure 2:
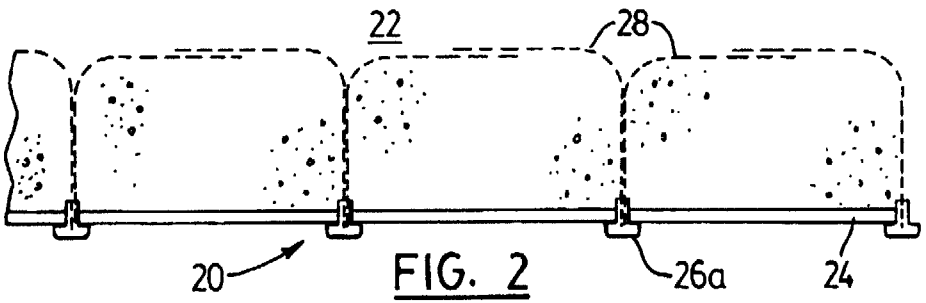
FIG. 2 is a cross-sectional plan view taken on line 2—2 of FIG. 1.

Reference is first made to FIGS. 1 to 3 which show a portion of a multi-tiered retaining wall (generally indicated by reference numeral 20) for supporting an embankment 22 typically backfilled with earth, such as gravel, soil or the like, according to a preferred embodiment of the present invention. The backfill should allow for proper drainage to avoid excessive expansion and contraction in the backfilled area and resultant damage to the retaining wall 20. The bottom of the exposed embankment, or bottom grade, is indicated by 23*a* and the top of the embankment or top grade is shown as 23*b*. The retaining wall 20 is constructed of wall panels 24 supported by posts 26 which are in turn anchored into the embankment by a wire mesh 28 commonly used in the construction of gabion-type retaining walls. The retaining wall of FIG. 1 has four tiers or courses 30 of wall panel and post assemblies or cells above the bottom grade 23*a*, each assembly formed by a panel 24 flanked on either side by a post 26. One tier of the retaining wall 20 (indicated by 32) is typically buried below the bottom grade 23*a* to prevent the bottom of the wall 20 from kicking out, as is conventional in retaining wall construction.

Figure 5:
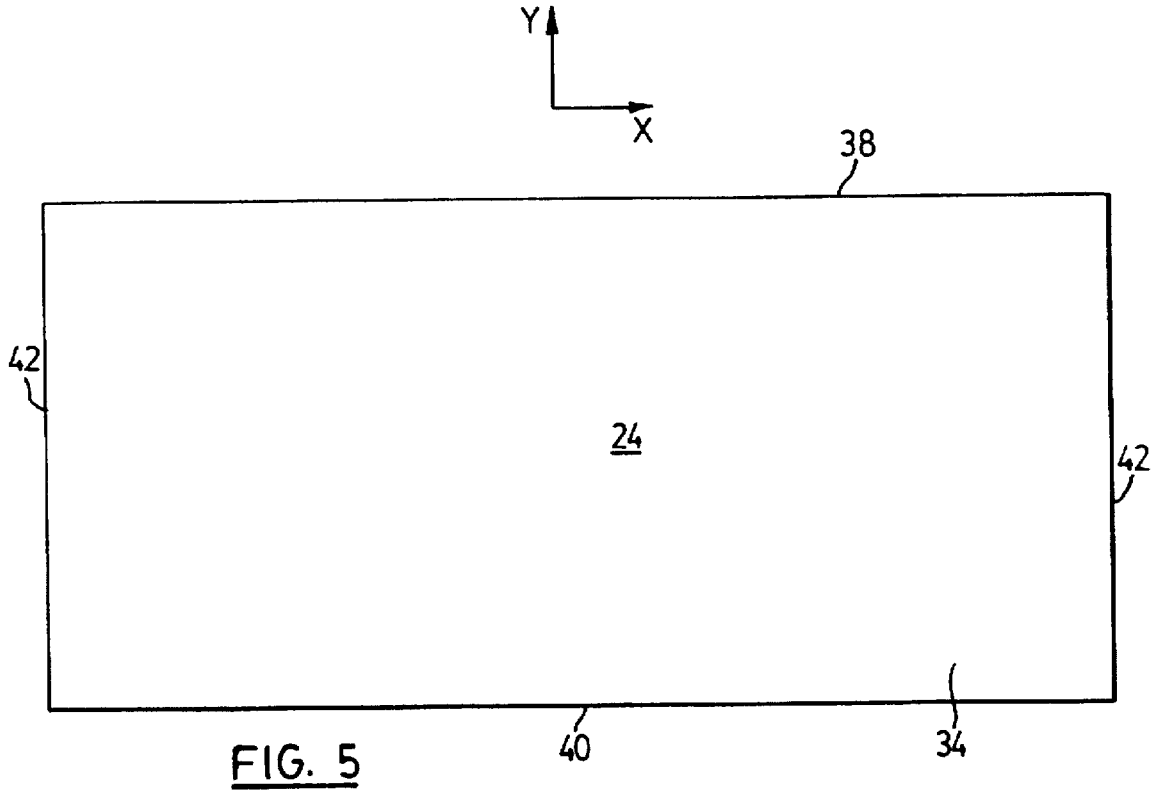
FIG. 5 is an isolated frontal view in elevation of a panel of FIGS.1–4.
Figure 6:
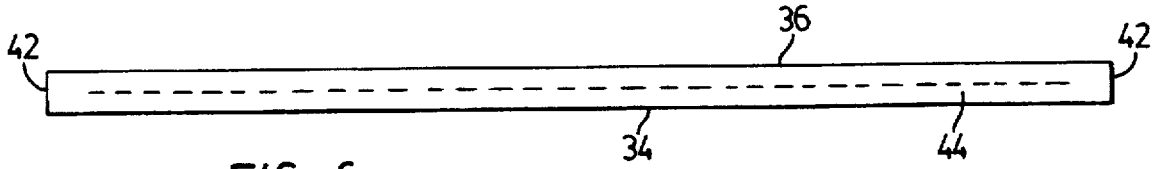
FIG. 6 is a cross-sectional plan view of the panel of FIG.5.

Referring now to FIGS.5 and 6 as well, each wall panel 24 for retaining the backfill of the embankment 22 has a generally planar, rectangular shape with a front surface 34, a rear surface 36 for contacting the backfill, opposed top and bottom edges 38 and 40, and opposed parallel side edges 42. In the preferred embodiment the panel is symmetrical about the x and y axis, and so the top and bottom edges may be reversed without consequence, as can the side edges for ease of installation. However, it will be appreciated that in certain circumstances, such as when the front surface 34 has architectural details for example, it may be necessary to retain a specified orientation. The concrete wall panel is reinforced with stainless steel mesh 44 or other reinforcement as required for structural integrity of the wall panel and the retaining wall overall. In the preferred embodiment the panel has a width (ie. the length of the top or bottom edges 38, 40) of about 5 feet (aprox. 1.52 m), a height (ie. the length of the side edge 42) of about 2 feet (aprox. 0.6 m) and a thickness (ie. the width of side edge 42) of about 4 inches (aprox. 102 mm). Different dimensions and materials may of course be used as required, as long as such changes are accounted for in the post design, discussed next.

Referring now to FIGS.4–8, each post 26 in the retaining wall 20 is structurally similar, except for the posts 26*a* in the underground tier 32 which are modified slightly for ground contact as noted later. In the preferred embodiment, the post 26 is also symmetrical about the y-axis (see FIG.7) for ease of construction and installation, hence like reference numbers will be used for like features on either side of the post. It is noted that references to "top", "bottom", and the like are used for ease of reference and refer to an element's general orientation when part of the retaining wall 20. In particular, "front", "back" and like references tend to indicate if a feature is facing or oriented close to the visible, outer area of the retaining wall or to the embankment side of the wall, respectively.

Figure 10:
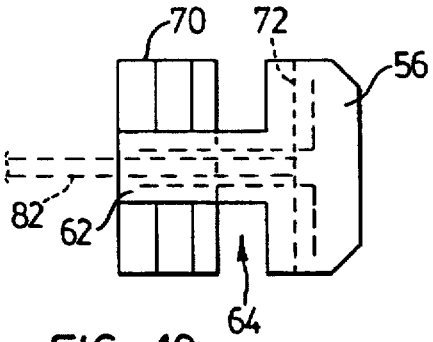
FIG. 10 is a cross-sectional plan view taken on line 10—10 of FIG.8.
Figure 9:
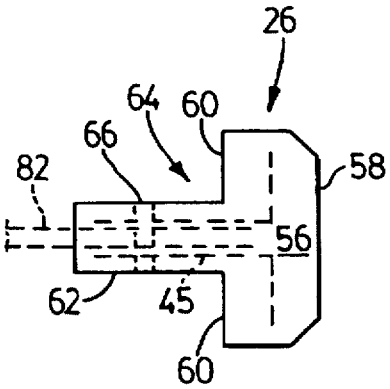
FIG. 9 is a cross-sectional plan view taken on line 9—9 of FIG.8.

The post 26 forms a rigid elongate concrete column with appropriate internal reinforcement some of which is indicated by 45 in FIGS.9 and 10. Unlike the wall panel 24, the post can not be twisted upside down or back to front upon installation for reasons which will be apparent below. The post 26 has an upper end 46, a lower end 48, and is substantially T-shaped in cross-section (as best seen in FIGS.9 and 10). A front portion of the post forms a laterally extending flange 56 having an outer face 58 and an opposed inner face 60. The outer face 58 may be beveled (as shown) or altered otherwise for artistic or architectural purposes. A back portion of the T-shaped post forms a web or stem 62 which extends rearwardly from the inner face 60 of the flange 56. In the preferred embodiment the web 62 is generally perpendicular to the flange 56, and the juncture of the web 62 and the flange 56 along a side portion of the post forms a substantially right-angled recess 64 for receiving the complementary shaped side edge 42 of the wall panel 24. Upon assembly of the retaining wall the panel's side edge 42 is proximate to or abuts the web 62, and an adjoining portion of the panel's front surface 34 abuts the flange's inner face 60. The panel 24 is retained in this abutting relationship prior to backfilling by a conventional pin 65 (indicated in FIG. 4 inserted into web aperture 66 located away from the flange's inner face 60 by at least the thickness of the panel. The aperture 66 should also be located toward the upper end 46 of the post as shown, namely above the centre of gravity of the panel, to resist any tendency for the panel to tip or pivot backwards toward the embankment prior to backfilling behind the retained panel.

Figure 4:
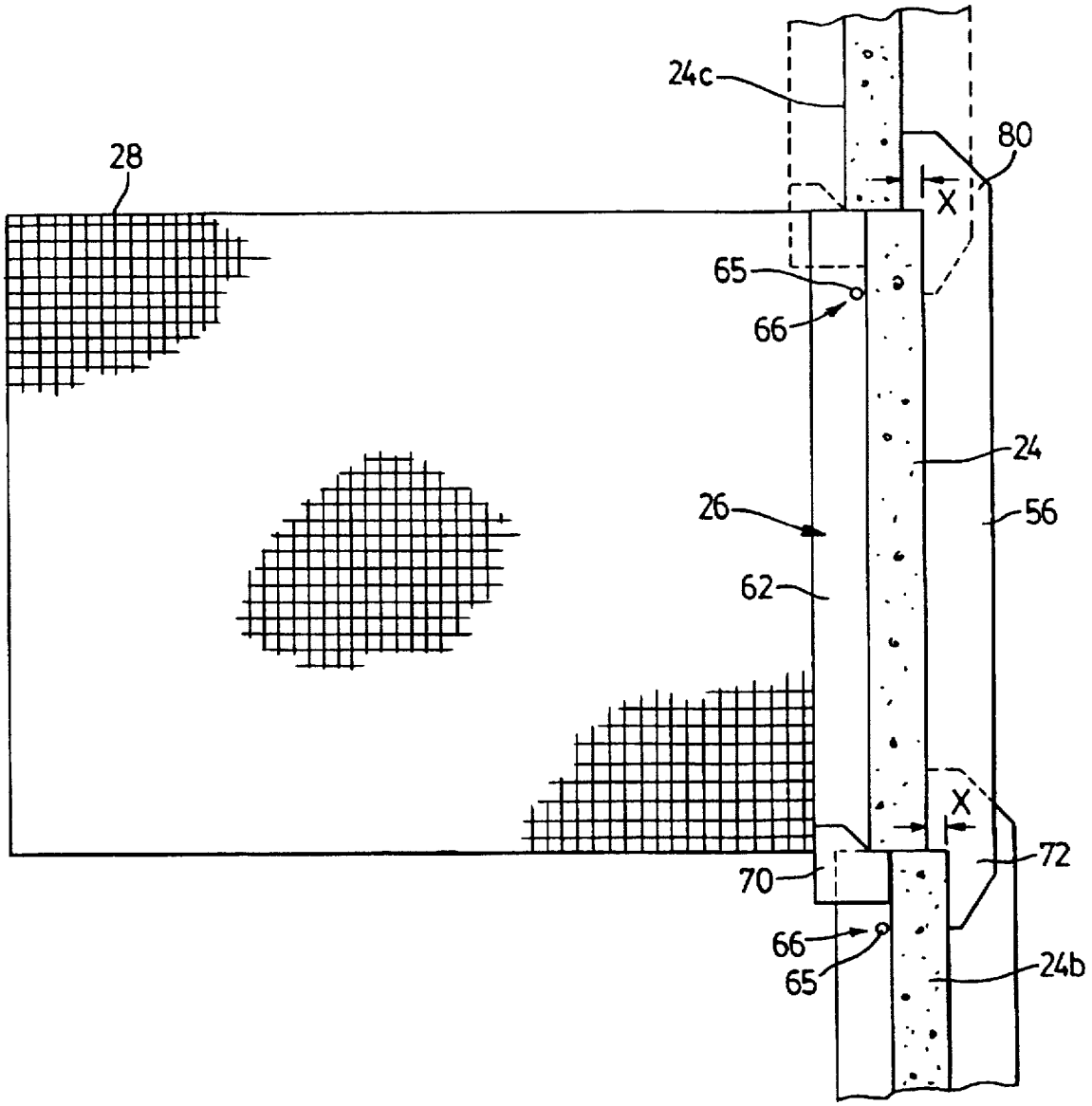
FIG. 4 is an enlarged view of a portion of the wall assembly of FIG.3.
Figure 8:
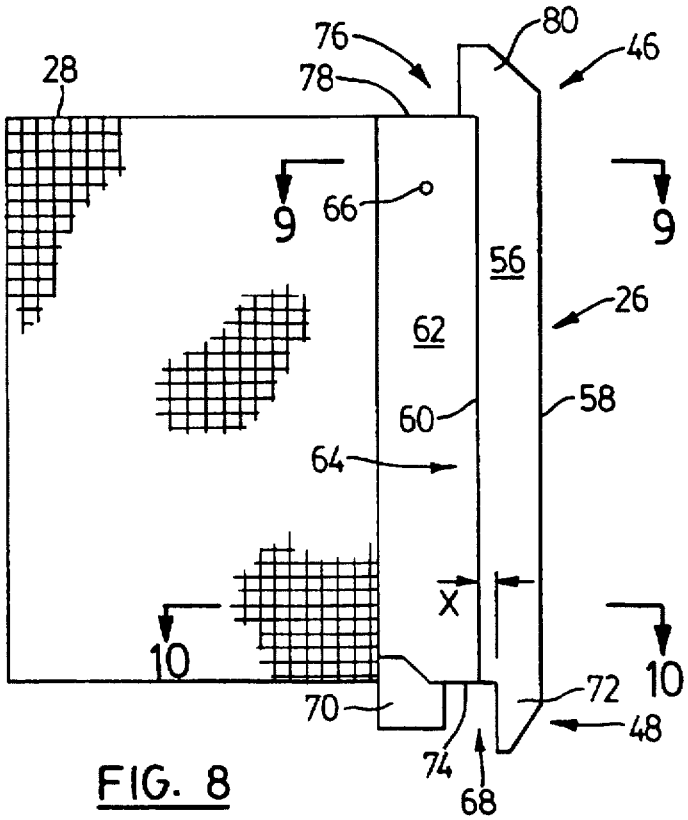
FIG. 8 is a side view of the post of FIG.7 showing a portion of a gabion-type wire mesh connected thereto.
Figure 7:
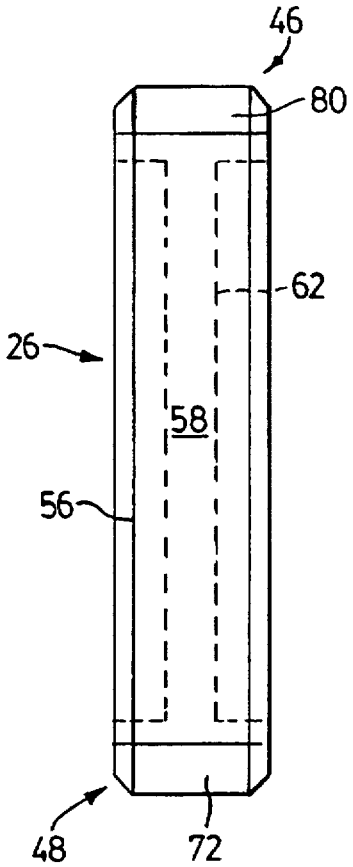
FIG. 7 is an isolated frontal view in elevation of a post of FIGS. 1–4.

The lower end 48 of the post 26 forms a saddle (as best seen in FIGS. 4 and 8) for supporting the post on the wall panel of an adjacent lower tier (indicated by 24*b* in FIG.4) prior to backfilling behind the post. The saddle is an inverted u-shaped slot 68 having a shape corresponding to a panel's top edge 38 for a snug fit thereon. The slot 68 is formed at the back by a heel 70 projecting from the web 62 and at the front by a toe 72 which is an extension of the flange 56. When inserted on the lower panel 24*b*, the heel 70 engages the panel's rear surface 36 and the toe 72 engages the panel's front surface 34. The heel and toe are of suitable width's and lengths to support the post on lower panel 24*b* in a free-standing manner, namely without the aid of further supports (eg. cables, lumber, etc.), even when a panel is mounted to the post via pin and aperture 66. Good results have been achieved in the preferred embodiment with a heel height of about 2 inches (aprox. 51 mm) measured from the ceiling 74 of the slot 68 and a toe height of 3 inches (aprox. 76 mm) from the ceiling. The width of both the heel 70 and toe 72 generally match that of the flange 56 (about 6 inches, or 152 mm), although all of these dimensions may vary as required.

The upper end 46 of the post has a seat 76 for supporting a wall panel of an adjacent higher tier (indicated by 24*c* in FIG.4). The seat 76 is formed by a relatively flat top surface 78 of the web 62 for engaging the correspondingly shaped bottom edge 40 of the higher panel 24*c*. The seat 76 also has an upper toe 80 extending from the flange 56. The upper toe 80 engages the front surface 34 of the higher panel 24*c* to resist sliding movement or kicking out of the bottom edge of the higher panel 24*c* away from the backfilled embankment.

The post 26 also incorporates a means of setting back successive courses 30 of the retaining wall toward or into the embankment 22, best seen in FIGS.3 and 4. A set-back distance of "X" (indicated in FIG.4) per course is achieved by offsetting the saddle 68 from the panel engaging recess 64 by a comparable amount, namely the lower toe 72 of saddle slot 68 is located forward of the inner face 60 of recess 64 by a distance of "X". Hence, when the wall panel 24 is mounted in recess 64 of post 26, the panel is automatically setback a distance "X" from the adjoining lower wall panel 24*b*. Consequently, the seat 76 of the post should also be offset a distance "X" rearwardly from the recess 64. In essence, the upper toe 80 is located back of the inner face 60 by a comparable distance "X" to match the set-back imposed by the saddle of the post on the adjacent upper tier (shown in ghost outline in FIG.4). It will be appreciated that providing the saddle 68 and the seat 76 with non-matching set-backs may produce undesirable results, such as interference by the seat 76 with insertion of the upper panel 24*c* therein, or the formation of a gap between the panel 24*c* and the seat 76 requiring insertion of shims or the like. In the preferred embodiment the set-back "X" is less than the thickness of the wall panel side edge 42 so that wall panels of adjacent tiers overlap and engage one another as shown. Such overlapping facilitates weight transfer through the retaining wall to its foundation. Although the set-back "X" may be greater than the panel width, this is not preferred due to loss of such favourable weight transfer and possible seepage through the resultant gap between vertically adjacent wall panels.

It is noted that the posts 26 employed in the underground tier 32 of the retaining wall do not engage a lower tier of wall panels, but rather sit on a foundation of compacted gravel, concrete or other suitable material. Consequently, the saddle feature is not required, and in fact is detrimental to the post's stability on a hard foundation where the protruding heel 70 and lower toe 72 can not be shoved into the substrate. Hence, the heel 70 and toe 72 are omitted or otherwise removed to provide the posts of the underground tier with a generally flat bottom to promote stability prior to backfilling.

Referring to FIGS.9 and 10, a mesh-like connector 82 is embedded in the post 26 and extends about 6 to 7 inches or more (aprox. 152 mm to 178 mm) away from the web 62. Wire or other suitable binder (such as high strength synthetic materials, tack welding, etc.) is used to connect the wire mesh 28 to the post 26. Two sets of mesh 28 are attached to each post, except for those along the vertical periphery of the retaining wall. The mesh 28 is arranged in a conventional manner as shown in FIGS.2 and 3 to form generally rectangular shaped, enclosures, the size or volume of which preferably decrease in successive tiers toward the top of the embankment in pyramid-like fashion. The mesh 28 from adjacent posts is preferably overlapped at the back of the enclosures and may be bound if desired. The backfilled enclosures therefore anchor the attached posts 26 to the embankment, as is appreciated by those skilled in this field.

It can now be appreciated how the retaining wall system of the present invention is formed, how it functions and some of the resulting benefits. Specific dimensions and distances are used for illustrative purposes only. Before arranging the first underground tier 32 of the retaining wall, a trench 90 (see FIG.3) is excavated to reach stable compactable soil, and is then partly filled with crushed gravel or other suitable material and compacted to a desired Proctor reading, typically at least 95%. The surface of the compacted gravel base 92 should be at a depth equivalent to the height of the first course of the wall, namely about 2 feet (aprox. 0.6 m) below the desired bottom grade 23*a*. The width of the trench in this example is about 6 feet (aprox. 1.8 m) to accommodate the enclosure formed by the mesh 28. The length of the trench will depend on the length of wall desired.

The underground tier 32 is then arranged sequentially, preferably in 50 foot (15 m) lengths. First and second posts 26*a* are set generally vertically near the front of the trench and spaced apart 5 feet (aprox. 1.5 m), the length of the wall panels 24. A wall panel 24 is then inserted between these two posts so that each panel edge 42 abuts the recess 64 of each post. A pin is then inserted into the aperture 66 of each post's web 62 to retain the panel in place. The pin should only engage the inserted panel and not protrude from the other side of the aperture 66 to avoid interference with insertion of the next adjacent panel A third post 26*a* is then set another 5 feet away from the second post and another panel is inserted in the resultant space therebetween, and pins are inserted in apertures 66 for support. The above procedure is repeated until the first 50 feet of the underground course is set. The meshes 28 are also attached to the posts at this time and arranged to form the previously discussed enclosures. Prior to backfilling this underground course of wall, it is important that the posts and wall panels be aligned and leveled as precisely as possible to ensure the proper placement of subsequent courses of the wall. Good results have been achieved with the following backfilling procedure: suitable backfill material is placed in the trench 90 on both sides of the posts and panels (namely at the front adjacent to the panels' front panel faces 34 and the posts' outer faces 58, and at the rear into the mesh enclosure 28) to about ⅓ to ½ the height of the posts; the level and alignment of the underground course is then checked and ad d as required; and subsequently the trench is filled completely in front of the posts and panels, followed by a complete fill of the mesh area 28 and the surrounding trench area behind the posts and panels. Hence the underground course 32 is virtually completely buried, except for some exposure of the top edges of the panels so that they may receive the next course. A good part of the time and cost of constructing the entire retaining wall 20 is spent preparing this underground course 32 to ensure its proper alignment and level, in which case the construction of subsequent courses proceeds relatively quickly and easily.

With the underground course of the wall completed, arrangement of the first "above grade" tier 30 of the wall may proceed. The first two posts 26 are set about 5 feet apart on the top edges 38 of the "buried" panels. The saddles 68 of these posts ensure that the posts are self-supporting (ie. free-standing) on the lower panels. A wall panel 24 is then inserted between both posts in a snug fit and retained in place by inserting pins into post apertures 66 as before. The mesh 28 may then be connected to the posts and arranged to form the desired enclosure. This cell or assembly of the retaining wall remains free-standing while the remainder of the first tier 30 is arranged in sequence. The mesh enclosures 28 should be backfilled before proceeding with the next higher tier so as to avoid damage to the mesh. Since there may be some play in the vertical alignment of the posts prior to backfilling, their alignment should be checked and adjusted, if need be, upon backfilling behind the posts in question. The above procedure is repeated for subsequent higher tiers (four in all in the embodiment shown) until the top of the embankment is reached and capped with the top grade 23*b*. It is noted that the posts in the FIG. 1 embodiment are supported at about the mid-point of the adjacent lower wall panel. Although such arrangement my be altered, it is desireable because it provides for a substantially balanced force distribution to the posts of the lower tier.

Other advantages of the present invention may now be better appreciated. First, the features of the above system provide for automatic elevation and alignment of the above ground tiers 30 once the underground course 32 is set properly, which minimizes the amount of on-site leveling and alignment work to be done, thus saving construction time and money. Second, the posts and panels are self-supporting during arrangement of the retaining wall, and so time and materials are not wasted in propping each of these element prior backfilling. In particular, each post is self-supporting without the aid or introduction of the wire mesh or other external anchoring features such as pins or rods. Hence, the wall tiers are completed quickly and efficiently compared to prior art retaining wall construction methods. Third, the posts 26 of the present invention are relatively light weight for ease of handling. Depending on specific configurations, the posts may weigh as little as 30 lbs. (aprox. 13.5 kg), allowing for easy manipulation by workers during construction. Although light weight, the posts are capable of carrying significant loads. Fourth, the posts provide the retaining wall with a pre-determined or "controlled" setback. Workers therefore need not waste time in the field checking whether each individual wall panel has the required set-back. The required set-back is achieved automatically as long as the posts are set properly, thus eliminating the possible errors inherent with establishing such set-backs manually in the field. Fifth, the present system lends itself to a wide variety of arrangements of the posts and panels in a single wall construction since posts of successive tiers are not restricted to alignment one atop another. For example, the posts on a second tier of a retaining wall may sit at the centre of the lower first tier wall panels, whereas the posts of the fourth tier may be shifted over for placement to one side of the lower third tier wall panels.

The above description is intended in an illustrative rather than a restrictive sense and variations to the specific configurations described may be apparent to skilled persons in adapting the present invention to specific applications. Such variations are intended to form part of the present invention insofar as they are within the spirit and scope of the claims below. For instance, some wall panels may be manufactured integrally with one or two posts, although this is not preferred because of potential handling and installation difficulties.

I claim:

1. An assembly for constructing a multi-tiered retaining wall to support a backfilled embankment comprising:

(a) at least one generally planar backfill retaining wall panel having opposed top and bottom edges, and opposed parallel side edges;

(b) at least two transversely spaced posts wherein said at least one wall panel spans between pairs of said posts, each of said posts comprising:

(i) a rigid elongate column having an upper end, a lower end and opposed side portions;

(ii) an abutment portion extending longitudinally along each side portion for receiving one of said side edges of said at least one wall panel;

(iii) means for retaining said at least one wall panel in place between a pair of said posts in said abutment portion prior to backfilling against a rear surface of said at least one wall panel;

(iv) a seat at said upper end of the column for supporting a wall panel on an adjacent higher tier;

(v) a saddle at said lower end of the column for free-standing support of said post on a wall panel on an adjacent lower tier prior to said backfilling; and (vi) means extending from said post for connection to a mesh for anchoring said post to said backfilled embankment.

2. The assembly of claim 1 wherein each of said posts further includes a set-back portion which provides a wall panel of an adjacent upper tier with a predetermined set-back into said embankment in relation to a wall panel in an adjacent lower tier.

3. The assembly of claim 2 wherein said set-back portion comprises said saddle offset forwardly of said abutment portion and said seat offset a corresponding amount rearwardly of said abutment portion.

4. The assembly of claim 2 wherein each of said at least two posts is substantially T-shaped in cross-section having a laterally extending flange with an outer face and an opposed inner face, and a web extending rearwardly from said inner face of the flange.

5. The assembly of claim 4 wherein said abutment portion comprises a recessed area formed at the juncture of said web and said flange for receiving a complementary shaped side edge of said at least one wall panel and for resisting movement of said complementary shaped side edge away from said backfilled embankment.

6. The assembly of claim 4 wherein said retaining means comprises a pin element insertable into an aperture in said web, said pin element engaging a rear surface of said at least one wall panel when said at least one wall panel is located in said abutment portion.

7. The assembly of claim 6 wherein said pin element engages said rear surface of said at least one wall panel above the centre of gravity of said at least one wall panel to resist the tipping over of said at least one wall panel toward said embankment prior to said backfilling.

8. The assembly of claim 4 wherein said seat comprises a planar top surface of said web for engaging a correspondingly shaped bottom edge of said adjacent upper wall panel.

9. The assembly of claim 8 wherein said seat includes means for resisting movement of said bottom edge of the adjacent upper wall panel away from said backfilled embankment.

10. The assembly of claim 9 wherein said movement resisting means comprises a portion of said inner face of the flange extending above said top surface of the web for engaging a front surface of said adjacent upper wall panel.

11. The assembly of claim 10 wherein said inner face of the flange extending above said top surface of the web is offset rearwardly from said inner face of the flange extending along the length of said web to provide a set-back to the adjacent upper wall panel supported by said seat.

12. The assembly of claim 4 wherein said saddle each of said at least two posts is of a shape corresponding to said top edge of the wall panel on said adjacent lower tier to provide a snug fit thereon.

13. The assembly of claim 12 wherein said saddle forms an inverted u-shaped slot, wherein one leg of said u-shaped slot extends from said web to form a heel element for engaging a rear surface of said lower tier panel, and an opposed leg of said u-shaped slot extends from said flange to form a toe element for engaging an opposed front surface of said lower tier panel.

14. The assembly of claim 13 wherein said toe element is offset forwardly of said inner face of the flange to provide a set-back to said at least one wall panel engaging the abutment portion of each of said at least two posts in relation to said lower tier panel engaged by said saddle.

15. In a multi-tiered soil retaining wall for a backfill embankment having at least one wall panel spanning between a pair of spaced posts, said at least one wall panel having opposed top and bottom edges and opposed generally parallel side edges, the improvement wherein each of said posts comprises:

a rigid elongate column having an upper end, a lower end and opposed side portions;

an abutment portion extending longitudinally along each side portion for receiving one of said side edges of said at least one wall panel;

means for retaining said at least one wall panel in said abutment portion;

a seat at said upper end of the column for supporting a wall panel on an adjacent higher tier;

a saddle at said lower end of the column for free-standing support of said column and any wall panel retained in said column's abutment portion on a wall panel on an adjacent lower tier prior to backfilling; and means for connecting said column to a mesh for anchoring said column to said backfilled embankment.

16. The retaining wall of claim 15 wherein each of said posts further comprises a set-back portion which provides a wall panel of an adjacent upper tier with a predetermined set-back into said embankment in relation to a wall panel in an adjacent lower tier.

17. The retaining wall of claim 16 wherein said set-back portion comprises said saddle offset forwardly of said abutment portion and said seat offset a corresponding amount rearwardly of said abutment.

18. The post of claim 16 wherein said column is generally T-shaped in cross-section having a laterally extending flange with an outer face and an opposed inner face, and a web extending rearwardly from said inner face of the flange.

19. The retaining wall of claim 18 wherein said abutment portion comprises a recessed area formed at the juncture of said web and said flange for receiving a complementary shaped side edge of said at least one wall panel and for resisting movement of said complementary shaped side edge away from said backfilled embankment.

20. The retaining wall of claim 18 wherein said retaining means comprises a pin element insertable into an aperture in said web, said pin element engaging a rear surface of said at least one wall panel when said at least one wall panel is located in said abutment portion.

21. The retaining wall of claim 20 wherein said pin element engages said rear surface of said at least one wall panel above the centre of gravity of said at least one wall panel to resist the tipping over of said at least one wall panel toward said embankment prior to said backfilling.

22. The retaining wall of claim 18 wherein said seat comprises a planar top surface of said web for engaging a correspondingly shaped bottom edge of a wall panel of an adjacent upper tier.

23. The retaining wall of claim 22 wherein said seat includes means for resisting movement of said bottom edge of the adjacent upper wall panel away from said backfill embankment.

24. The retaining wall of claim 23 wherein said movement resisting means comprises a portion of said inner face of the flange extending above said top surface of the web for engaging a front surface of said adjacent upper wall panel.

25. The retaining wall of claim 24 wherein said inner face of the flange extending above said top surface of the web is offset rearwardly from said inner face of the flange extending along the length of said web to provide a set-back to the adjacent upper wall panel supported by said seat.

26. The retaining wall of claim 18 wherein said saddle is of a shape corresponding to said top edge of the wall panel on said adjacent lower tier to provide a snug fit thereon.

27. The retaining wall of claim 26 wherein said saddle forms an inverted u-shaped slot, wherein one leg of said u-shaped slot extends from said web to form a heel element for engaging a rear surface of said lower tier panel, and an opposed leg of said u-shaped slot extends from said flange to form a toe element for engaging an opposed front surface of said lower tier panel.

28. The retaining wall of claim 27 wherein said toe element is offset forwardly of said inner face of the flange to provide a set-back to said at least one wall panel engaging the abutment portion of said column in relation to said lower tier panel engaged by said saddle.

29. A post for use with at least one wall panel spanning between pairs of said posts to construct a retaining wall for supporting an embankment, said post comprising:

a rigid elongate column having an upper end, a lower end and opposed side portions;

an abutment portion extending longitudinally along each side portion for receiving a side edge of said at least one wall panel;

a seat at said upper end of the column;

a saddle at said lower end of the column for free-standing support of said column on a wall panel; and means for connecting said column to a mesh for anchoring said column to said embankment.

30. The post of claim 29 further comprising a set-back portion for providing a wall panel with a predetermined set-back into said embankment.

31. The post of claim 30 wherein said set-back portion comprises said saddle offset forwardly of said abutment portion and said seat offset a corresponding amount rearwardly of said abutment.

32. The post of claim 29 wherein said column is generally T-shaped in cross-section having a laterally extending flange with an outer face and an opposed inner face, and a web extending rearwardly from said inner face of the flange.

33. The post of claim 32 wherein said abutment portion comprises a recessed area formed at the juncture of said web and said flange.

34. The post of claim 32 wherein said seat comprises a planar top surface of said web.

35. The post of claim 34 wherein said seat includes means for resisting movement of a wall panel away from said embankment.

36. The post of claim 35 wherein said movement resisting means comprises a portion of said inner face of the flange extending above said top surface of the web.

37. The post of claim 36 wherein said inner face of the flange extending above said top surface of the web is offset rearwardly from said inner face of the flange extending along the length of said web.

38. The post of claim 32 wherein said saddle forms an inverted u-shaped slot having two opposed legs extending from said lower end of the column.

39. The post of claim 38 wherein said opposed legs are offset forwardly of said seat to provide a wall panel with a predetermined set-back into said embankment.

40. The post of claim 29 further including a means for retaining said at least one wall panel in said abutment portion.

* * * * *